US008448349B2

(12) United States Patent
Kloeppel-Riech et al.

(10) Patent No.: US 8,448,349 B2
(45) Date of Patent: May 28, 2013

(54) HAIR CARE DEVICE WITH FUNCTION HEAD

(75) Inventors: Michael Kloeppel-Riech, Friedberg (DE); Timo Hasenpflug, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 555 days.

(21) Appl. No.: 12/674,732

(22) PCT Filed: Jul. 25, 2008

(86) PCT No.: PCT/EP2008/006131

§ 371 (c)(1),
(2), (4) Date: May 27, 2010

(87) PCT Pub. No.: WO2009/015832

PCT Pub. Date: Feb. 5, 2009

(65) Prior Publication Data

US 2011/0088275 A1 Apr. 21, 2011

(30) Foreign Application Priority Data

Jul. 27, 2007 (DE) ..... 10 2007 035 247

(51) Int. Cl.
*A45D 20/12* (2006.01)

(52) U.S. Cl.
USPC ..... 34/97; 34/100; 132/272; D32/28; 392/385

(58) Field of Classification Search
USPC ..... 34/96, 97, 98, 99, 100; D32/28; 132/271, 132/272, 228; 392/384, 385
See application file for complete search history.

(56) References Cited

U.S. PATENT DOCUMENTS

| | | | | |
|---|---|---|---|---|
| 3,949,765 | A * | 4/1976 | Vallis | 132/120 |
| 4,936,027 | A * | 6/1990 | Tsuji | 34/90 |
| 5,150,491 | A | 9/1992 | Ikemoto | |
| 6,827,088 | B2 * | 12/2004 | Taylor et al. | 132/116 |
| 7,584,759 | B2 | 9/2009 | Yasuda et al. | |
| 8,272,142 | B2 * | 9/2012 | Hall | 34/96 |
| 2002/0062836 | A1 * | 5/2002 | Saida et al. | 132/271 |
| 2004/0020070 | A1 * | 2/2004 | Ito | 34/96 |

(Continued)

FOREIGN PATENT DOCUMENTS

JP 2004/344354 A 12/2004

OTHER PUBLICATIONS

All Office Actions, U.S. Appl. No. 12/674,051.
All Office Actions, U.S. Appl. No. 12/674,053.
All Office Actions, U.S. Appl. No. 12/669,915.
All Office Actions, U.S. Appl. No. 12/673,981.

*Primary Examiner* — Stephen M. Gravini
(74) *Attorney, Agent, or Firm* — Jeffrey V Bamber; Kim W Zerby

(57) ABSTRACT

The present invention relates to a hair care device (1), having a handle (3), a application head (4) which can be connected to the handle (3) and has a hair treatment device (5), particularly a bristle and/or a tooth field, and having an ion discharging device (9) with at least one ion outlet (11) for discharging ions onto the hair. According to the invention, the hair care device (1) is characterized in that the application head (4) and/or a part of the housing surrounding the ion outlet (11) has at least one grounding surface for dissipating/limiting electrical charges. Advantageously, the ions are discharged exclusively from the back (8) of the device facing away from the hair treatment device (5), while the grounding surface can be provided on the application head (4) on the front side of the device.

14 Claims, 9 Drawing Sheets

A - A

U.S. PATENT DOCUMENTS

Figure 1:
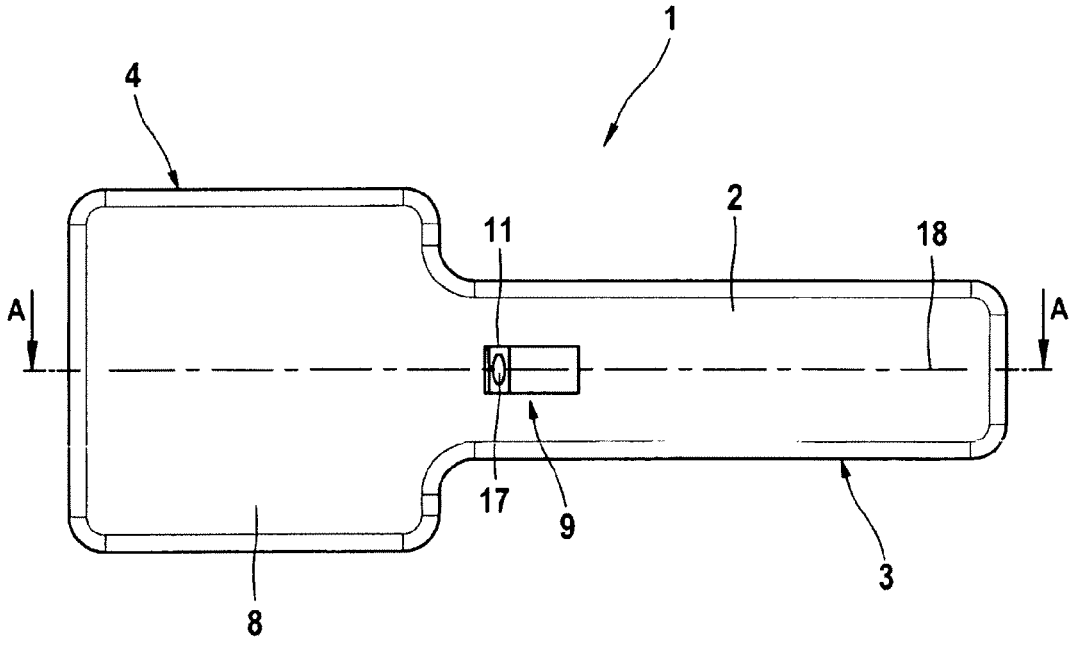

| | | | | |
|---|---|---|---|---|
| 2004/0129288 | A1* | 7/2004 | Saida et al. | 132/228 |
| 2005/0016559 | A1* | 1/2005 | Saida et al. | 132/271 |
| 2005/0076930 | A1* | 4/2005 | Yuen et al. | 132/132 |
| 2005/0172979 | A1* | 8/2005 | Saida et al. | 132/228 |
| 2011/0005539 | A1 | 1/2011 | Honnefeller et al. | |
| 2011/0088714 | A1 | 4/2011 | Kloeppel-Riech et al. | |
| 2011/0094535 | A1 | 4/2011 | Honnefeller et al. | |
| 2011/0315158 | A1 | 12/2011 | Kloeppel-Riech et al. | |

* cited by examiner

A - A

A - A

HAIR CARE DEVICE WITH FUNCTION HEAD

The present invention relates to a hair care device with a handle, an application head that can be attached to the handle, having a hair treatment device, in particular a bristle field and/or comb tooth field, and having an ion discharging device for discharging ions onto the hair which has at least one ion outlet.

Recently, hair care devices, particularly hair brushes, have been known that produced ions, as an supplemental application in addition to their primary function, that is, in the case of a hairbrush, to comb, brush and style the hair. Ions of this kind are usually molecules charged with negative electrons. With the help of such an ion application, the hair and the hair care can be improved; in particular a static charge on the hair causing it to stand up can be avoided.

From US 2005/284495 a hair brush or a hair dryer with an integrated brush attachment is known which has an ion outlet which releases ions in the direction of the application head, both on the back side of the device facing away from the bristle field, as well as on the front side of the device which bears the bristle field.

With these kinds of hair care devices having ion application, the ions should, on the one hand, naturally be well-directed to the hair, and on the other hand, they should not be applied selectively in certain spots, but should rather be applied as evenly as possible to the hair. In this, the ion discharge is impeded not only by direct mechanical obstacles such as hair or the user's hand coming in front of the ion outlet, but also by electrostatic counter fields which are produced by strongly negatively charged components repelling the negatively charged ions, or components with highly positive charges which have an attractive field-effect on the ions. This kind of charge can even arise from the bristle field, for example, when the hair is brushed with it. Also in the area of the ion discharge, electrostatic fields can be produced which impede the discharge of the ions.

A further aspect of the previously known hair care devices of the type mentioned above which needs improvement is user safety, which can be impaired by the above mentioned strong charges. As a result, the object of the present invention is based on creating a hair care device of the kind described which avoids the disadvantages of the prior art and develops this in an advantageous way. In particular, that by simple means, ions will be delivered onto the hair in an even, efficient manner without compromising the user safety of the device.

According to the invention, this object is achieved by a hair care device according to claim 1. Preferred embodiments of the invention are the subject matter of the dependent claims.

Therefore, it is proposed that electrostatic charge and counter fields be eliminated through appropriate counter measures, at least on the parts of the hair care device standing in the way of delivering the ions to the hair or that interfere with the discharge of the ions. Without interference from such electrostatic counter fields, a uniform but nevertheless targeted and efficient distribution of ions can be applied to the hair, with a simple design of the ion discharging device, which can be achieved, in the case of a simple design of the invention, with only a single ion outlet. According to the invention, the hair care device is characterized in that the application head and/or the part of the housing surrounding the ion outlet has at least one first grounding surface for dissipating/limiting electrical charges and the above mentioned back of the device, is provided with at least a second grounding surface preferably on an inside surface. This second grounding surface can also be in the vicinity of the ion outlet, but this is not required.

The grounding surface, that is, both the first grounding surface and the second and further grounding surfaces, can be configured in any way. They can have a planar or a point contact area, through which electronic charges are dissipated or limited. Additionally, they can have a contact plate attached to another surface, for example, to the inside surface or outside surface of a plastic component, for example through adhesive sealing. The contact surface can be designed to be rigid or flexible. Additionally, the grounding surface can comprise an electric contact screw, which is screwed into a screw boss in the plastic component.

The grounding surface is considered to be "in the vicinity" of another if it can affect the other component, that is, if it is capable of dissipating/limiting the electronic charge of the other component. The component can be in direct contact with the grounding surface or only in indirect contact. Even in indirect contact, the distance to the component should not be greater than 1 or 5 or 10 millimeters. The interval can depend on the electrical conductivity of the component or of the spanning component.

Further, the application head and/or a housing component in the vicinity of the ion outlet can at least have an additional grounding surface for dissipating/limiting electrostatic charges ("third grounding surface"). Such a grounding surface on the application head and/or on one of the housing components encasing the ion outlet prevents or limits an excessive charge and accordingly the electrostatic fields in the area of the application head and in the area of the ion outlet, which could impede the application of ions to the hair. In particular, such grounding surfaces could be present both on the application head and on the housing component in the vicinity of the ion outlet.

The grounding surface can be designed fundamentally differently. In particular, the grounding surface can be designed as a metal surface which can be mounted on a non-conductive, preferably plastic, body or housing component of the application head and/or of the ion outlet. The body of the function component or the ion outlet itself can further be designed as an injection molded plastic component or a plastic component manufactured in some other way. The grounding surface in the form of a metal surface which is advantageously attached to the outer surface of the body component mentioned above and can form its outer surface, not only prevents fields created by ion discharge, but also increases the operational safety of the hair care device.

In a further advantageous embodiment of the invention, alternatively or in addition to a grounding surface on the outside of a body component, a grounding surface can be provided on an inside surface of a body component. Thus, the arrangement on the inner or outer surface can vary, depending on the component. While the grounding surface on the said application head and/or on one of the outlet housings encasing the ion outlet can be advantageous on an outside surface of the corresponding body component, on the other hand, certain advantages are associated with providing a grounding surface or device on the inside surface of a further corresponding body component in the vicinity of the ion outlet, in particular on a body component over which the ion cloud diffuses, located behind the outlet in the discharge direction.

Regarding the arrangement of the grounding surfaces, various embodiments can be advantageous. On the application head, an advantageous arrangement can consist of attaching the grounding surface to the hair treatment device, in particular to the bristle field and/or to the comb tooth field. For example the grounding surface can form the bed, so to speak, that bears the bristles or comb teeth of the bristle field or optionally also other differently designed treatment tools for the hair treatment device. Alternatively, or in addition to the above mentioned bristle field and/or comb tooth field, the hair treatment device can have a hair-care surface, for example, made of a suitable material, such as ceramic, for example. Alternatively, or in addition, a heating surface can be provided having an appropriate shape, in particular a smooth, concave and/or convex rounded working surface.

Also regarding the arrangement of the grounding surface at the ion outlet ("first grounding surface") as well as in its vicinity, various arrangements can be advantageous. According to an advantageous embodiment of the invention, the ion outlet comprises a preferably separate housing module in the shape of a case or box, which encases the high voltage element producing the ions and has an orifice in which an outlet opening is provided for discharging the ions produced by the high voltage element. Advantageously, the grounding surface mentioned above is arranged on the side facing away from the orifice side of the above mentioned housing module. In particular, the orifice side of the housing module can be designed to be completely free of counter electrodes. In this way, the grounding surface can be attached on a side surface of the outlet housing adjacent to the orifice side, which peripherally encloses the above mentioned high voltage element which is preferably bar shaped, pin shaped or pointed. Alternatively, or in addition, a grounding surface can also be provided on a back side surface of the outlet housing opposite the orifice side.

Alternatively, or in addition to such a grounding surface on the outlet housing, a housing module adjacent to the ion outlet and/or a housing surface in the vicinity of the ion outlet can be provided with a grounding surface ("second grounding surface"). In particular, a housing module can be grounded downstream from the ion outlet over which the ion cloud diffuses or should diffuse, wherein this housing module advantageously is made of a non-conductive material in the manner mentioned above and can be provided with a grounding surface mounted on it. In this connection, in the simplest embodiment, the electrical grounding of the housing module in the vicinity of the ion outlet can be achieved by means of an electrically contacted screw which is screwed into a screw boss in the plastic component. Alternatively or additionally, the electrical grounding can be accomplished by means of pressure from a metal electrode forming a grounding surface of the kind mentioned above. In this way, the above mentioned housing component or components can be grounded by contact with the ground of the device's circuit, whereby an electrostatic charge, while not entirely impossible, is sufficiently limited to keep the electrical counter fields created by the charge so small that they do not impede the dispersion of the ions from the ion outlet.

The electrical grounding of the housing component over which the ion cloud disperses is achieved advantageously not in the visual field of the ion cloud but rather on one of the sides of the housing component facing away from the ion outlet, in particular one of the inner surfaces of the housing component.

According to an advantageous embodiment of the invention and in particular of the second grounding surface, the device housing is provided with a ion guide mechanism or ion control device in the area over which the ion cloud being discharged from the ion outlet disperses, and/or in the vicinity of the ion outlet. Control of the ions can be achieved advantageously in this way, so that several separate housing components are provided in the vicinity of the ion outlet, at least one of which is grounded and at least another is ungrounded. While the ungrounded housing component becomes electrically charged and therefore can divert the ions, the ions can spread out unhindered over the grounded housing components, so that, with a suitable pattern of grounded and ungrounded housing components, the distribution of the discharged ions is appropriately controlled.

Depending on the use, such an ion guiding device can be designed differently, in order to create different distribution patterns. In a preferred embodiment of the invention, a pattern can be provided of grounded and ungrounded housing components arranged symmetrically in the vicinity of the ion outlet around the longitudinal plane of the device, resulting in a completely symmetrical ion distribution. Alternatively, however, in order to create a device specifically for right-handed users or for left-handed users, for example, configurations different from symmetry around the longitudinal plane are possible.

Alternatively, or in addition to the embodiment mentioned above, in order to attach the grounding surface directly to the hair treatment device, the grounding surface on the application head ("third grounding surface") can also enclose the hair treatment device peripherally, at least in sections, preferably arranged in a ring and/or directly adjacent to the hair treatment device. In particular, a metal strip around the hair treatment device on the application head can be provided as a grounding surface. In this way the hair treatment device itself, that is, for example, the bristle field and/or comb tooth field, or the housing body of the application head itself should be made of non-conductive material. Advantageously, the grounding surface on the application head is not in the immediate vicinity of at least one ion outlet. Advantageously, the grounding surface can be positioned in the application head containing the hair treatment device on the edge next to the hair treatment device.

In a further embodiment of the invention, the housing potential is also electrically connected with the user's body. In an embodiment of the invention, the handle of the hair care device can have an electrically conductive contact surface for dissipating positive charges on the user of the hair care device. In this way, the user is protected from a static charge. Delivering negative ions can actually charge the user negatively. On the other hand, positive charge can be transferred to the user through the contact surface on the handle, thereby compensating for the charging effect of the negative ions. This is especially advantageous in a design of the hair care device not connected to the electrical power supply, in particular, a battery and/or a rechargeable battery device. With such a non-network device, the generation of negative ions normally produces an equivalent amount of positive charge on the device, because the battery device or rechargeable battery device lacks the reference potential. By means of this positive charge on the device, negative charging of the user can be offset by the electrically active contact surface on the handle mentioned above.

By means of the largely interference-free delivery of ions onto the hair, achieved by means of grounding surfaces which eliminate or reduce the charge fields on the device, an especially simple design of the ion delivery device is possible, in particular with regard to an ion discharge configuration. In a further embodiment of the invention, in particular, the ion delivery can take place exclusively on the back side of the device, facing away from the hair treatment device performing the primary function of the hair care device. Surprisingly, an evenly distributed and nevertheless targeted delivery of ions can be directed to the hair in this way. Until now, it has been attempted to deliver at least a portion of the ions to the front side of the device in the vicinity of the hair treatment tool, in order to supply the ions directly in the area to be treated, because it was assumed that ions discharged from the backside of the device more or less miss the target, namely the hair to be treated. In particular, in connection with the above described grounding surfaces and eliminating or limiting disruptive charge fields, discharging ions on the back side of the device can result in an especially even distribution and nearly complete discharge of ions onto the hair, because the hair usually has a positive charge which attracts the ions—compensating for the discharged ions. This effect is sufficient, if no stronger interference fields are present to impede the discharge of the ions. By positioning the ion outlet or all of the ion outlets on the back side of the device, the ions are emitted without mechanical interference from the user's hand or from strands of hair near the ion outlet.

In principle, a single ion outlet can be sufficient. Optionally, several ion outlets can be arranged on the back side of the device. In both cases, the arrangement is advantageously symmetrical around the longitudinal plane of the hair care device. Preferably, the at least one ion outlet or the several ion outlets are placed so that the main direction of ion emission or the sum of the main directions of ion emission is directed toward the plane of the back surface or over the back surface symmetrical to the longitudinal plane. In this way, the main direction of ion emission from the ion outlet is advantageously—roughly speaking—aligned essentially parallel to the back surface, so that the ions are emitted out over this essentially parallel to the back side of the device. Alternatively, or in addition, ions can be released at a slightly acute angle (upward). In doing so, ions can be released inclined at an angle of preferably 0° to 45°, preferably 0° to 30°, toward the surface of the back side.

To achieve an even distribution of ions on the hair, the at least one ion outlet is arranged on the edge of the back surface of the device, situated opposite the hair treatment device so that the ion cloud forms over the back side of the application head.

In positioning only a single ion outlet, it is advantageously arranged in the longitudinal plane itself. In positioning two ion outlets on the back side of the device, these can be arranged so that they stick out at the same height, preferably slightly inclined toward the center plane. Alternatively, in positioning two ion outlets on the back side of the device, an opposing configuration can be used so that the two ion outlets are arranged on opposite edges of the rear surface of the application head and are aligned one on top of the other so as to allow the ions to discharge sequentially, so to speak.

The hair treatment device can be securely mounted to the application head and can also be permanently integrated into the application head. Alternatively, the hair treatment device can advantageously be interchangeably mounted on the application head so that various hair treatment devices can be attached to an application head and usable with a application head. In addition to a bristle field or comb tooth field, other hair treatment devices can be considered, as for example: a device for heat treatment, a heatable hair straightener, a hot air device, perhaps in the form of a hair dryer or a hot air brush. Generally, such various hair treatment devices require different kinds of handling and grasping of the device, so that it is advantageous to offer electrically conductive surfaces of the kind disclosed. In addition, the ion stream should be delivered in such a way that both its strength and its geometrical distribution are very compatible with a variety of application heads.

Figure 2:
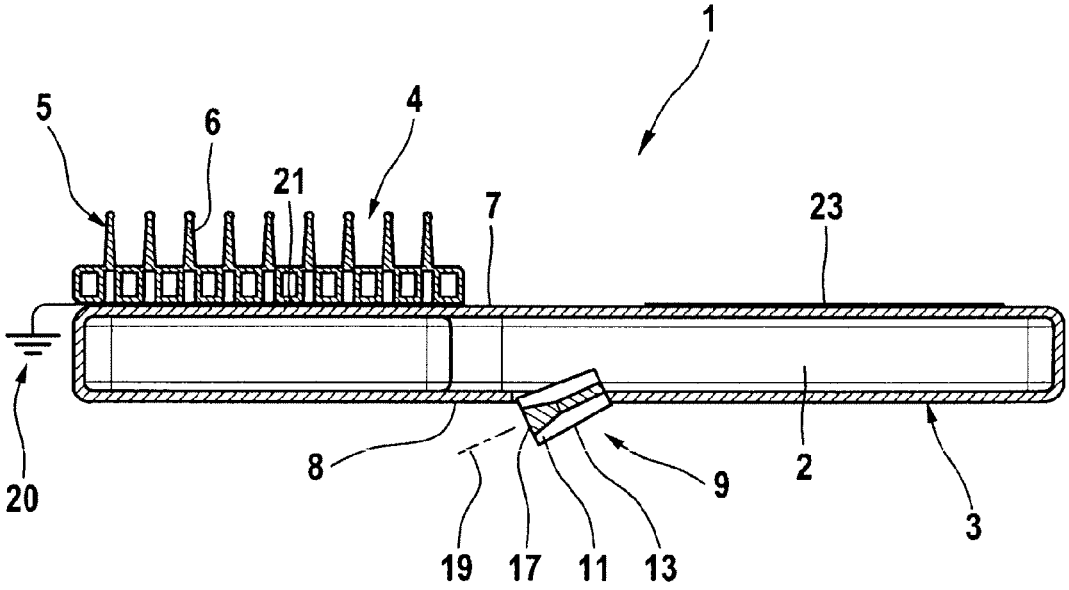
Figure 3:
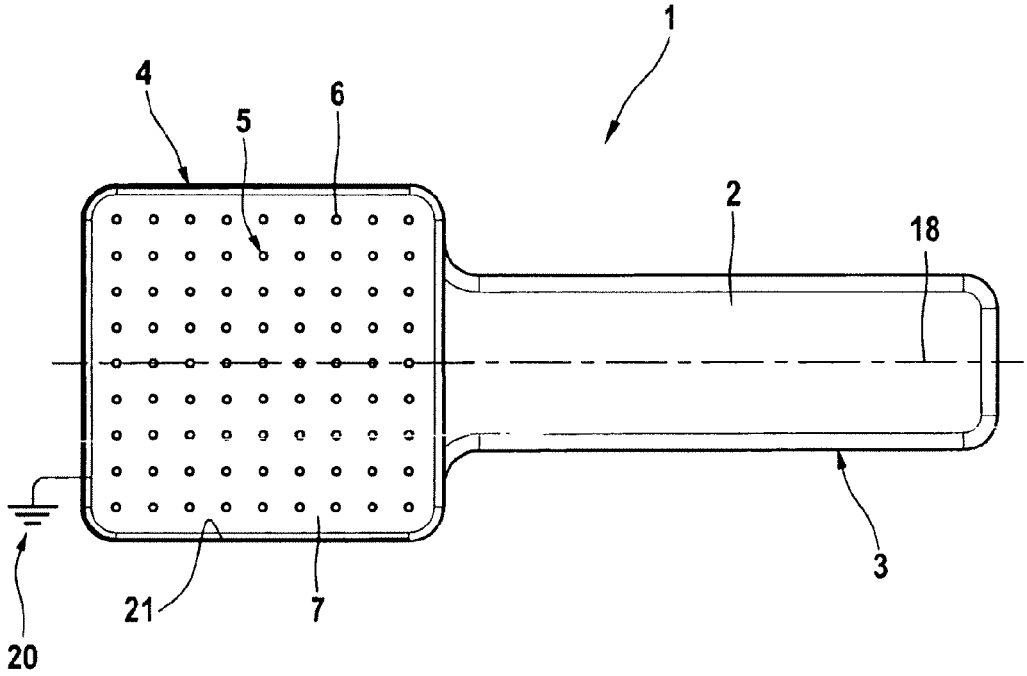
Figure 4:
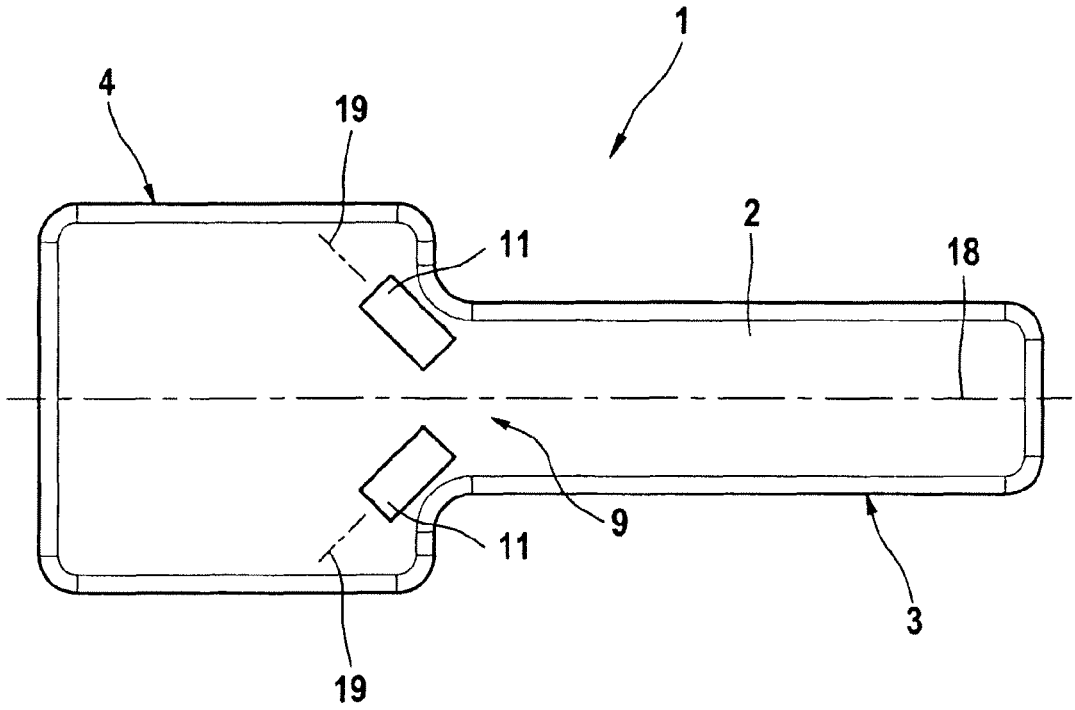
Figure 5:
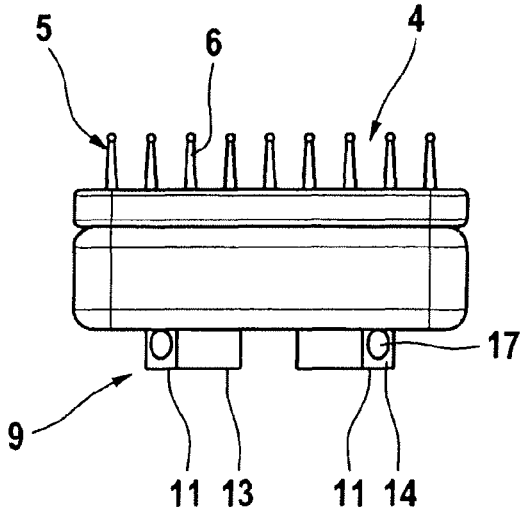
Figure 6:
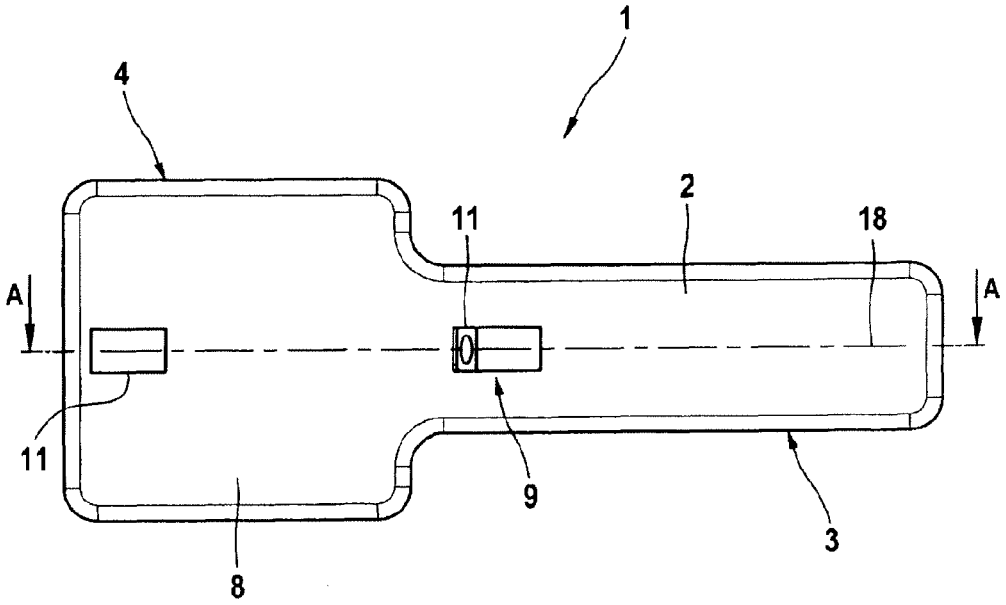
Figure 7:
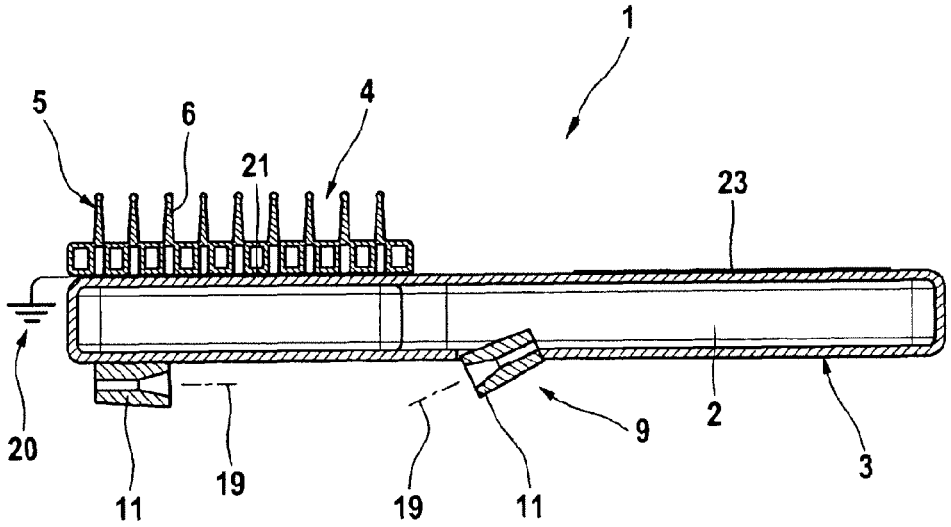
Figure 8:
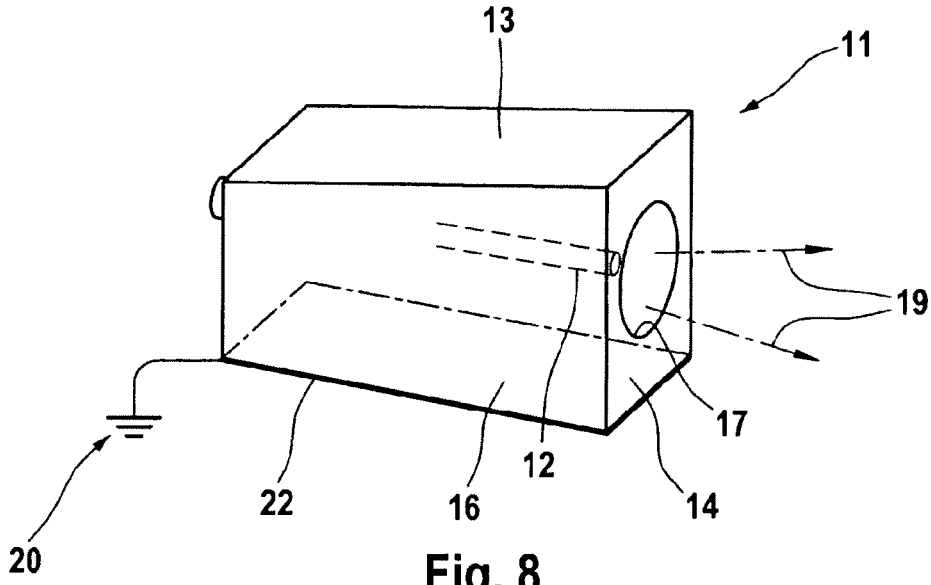
Figure 9:
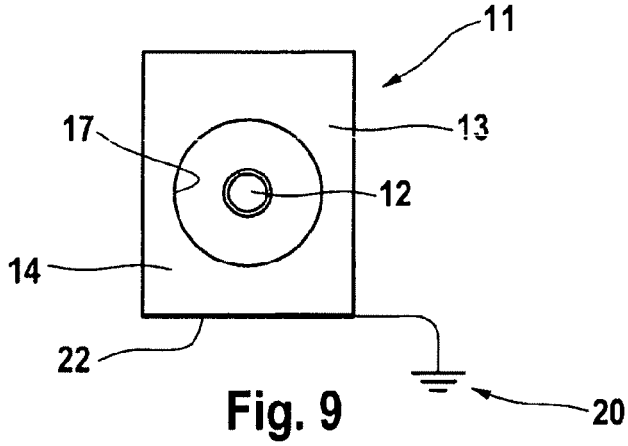
Figure 10:
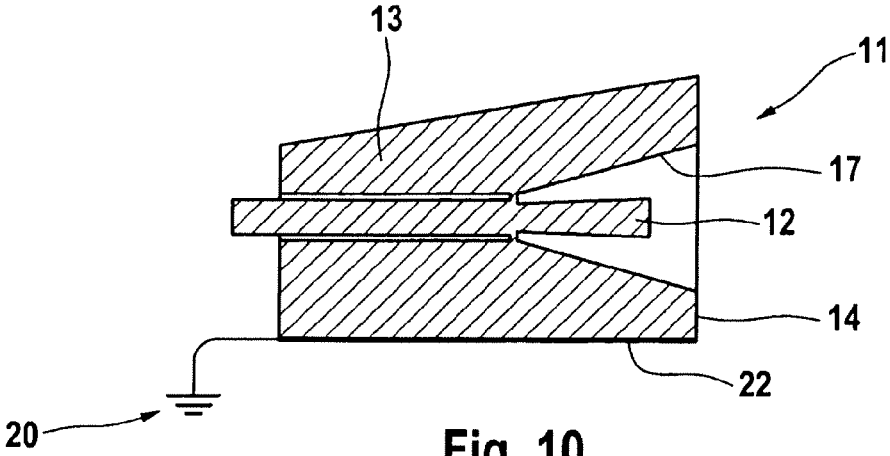
Figure 11:
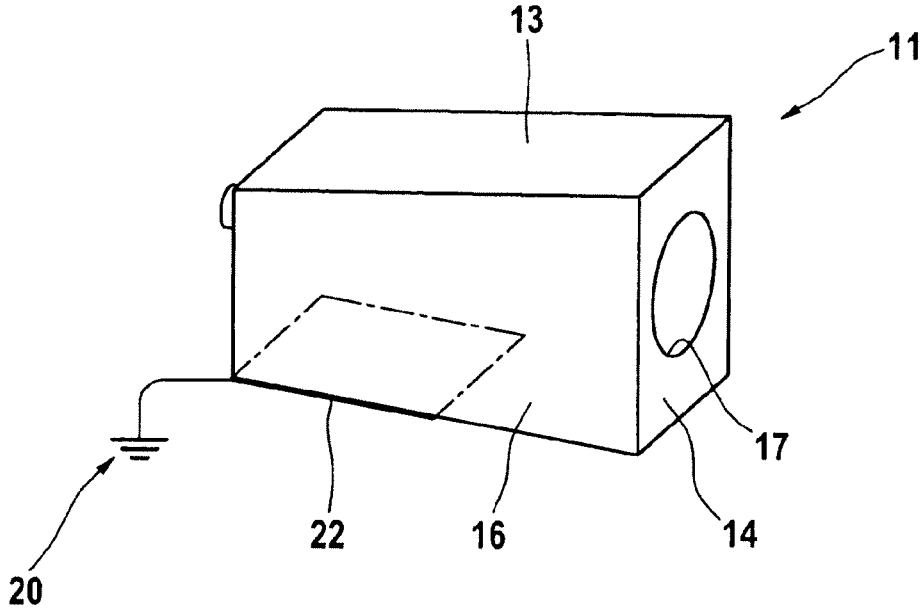
Figure 12:
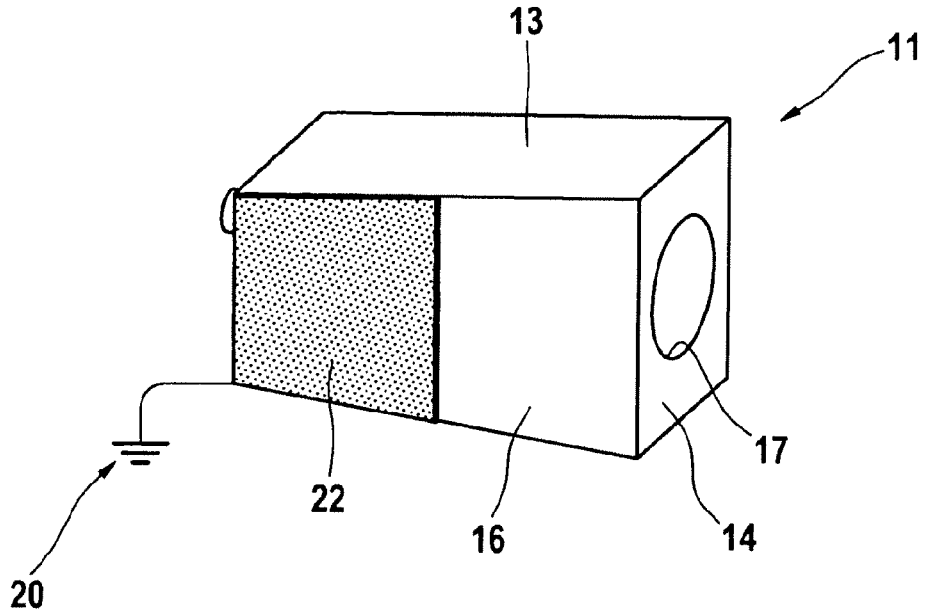
Figure 13:
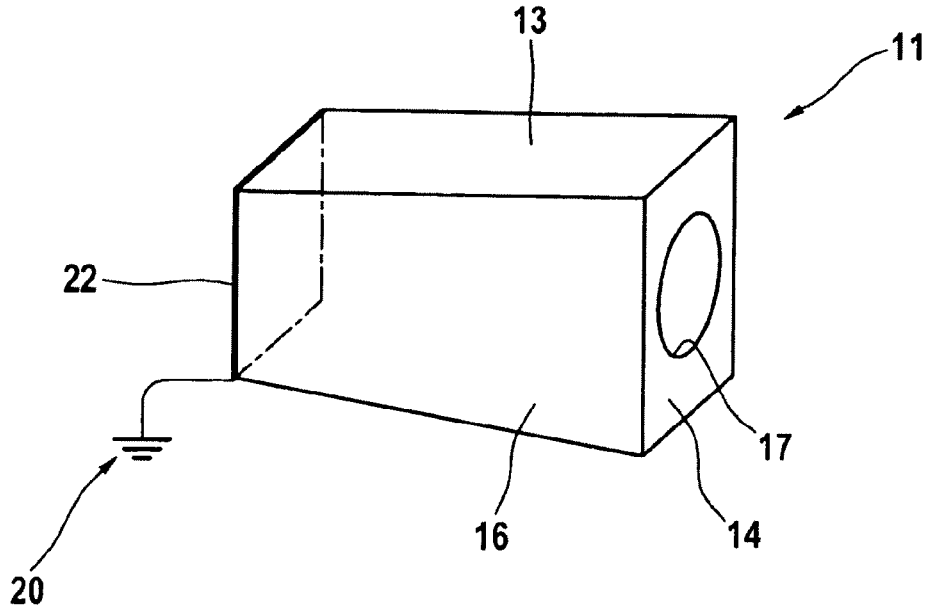
Figure 14:
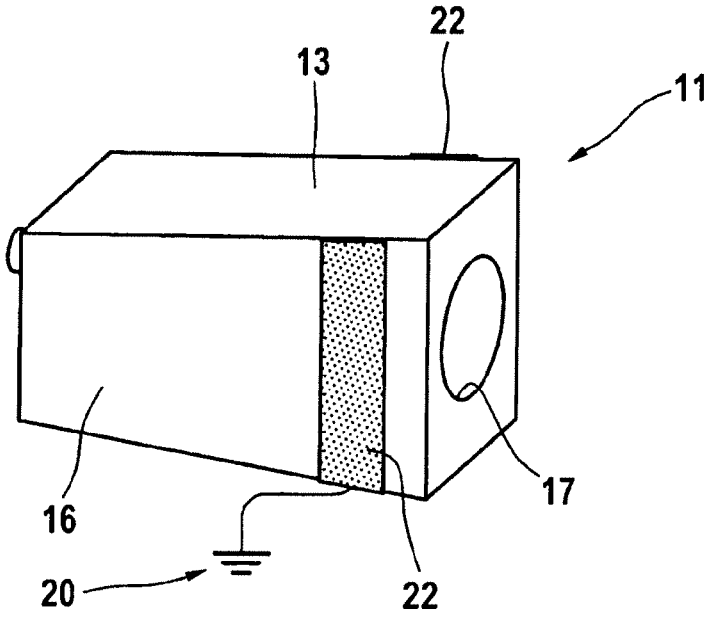
Figure 15:
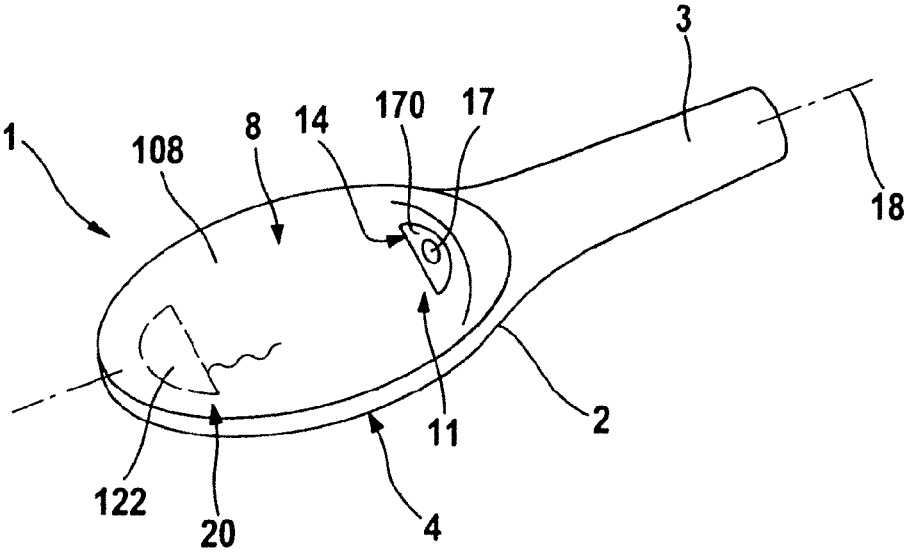
Figure 16:
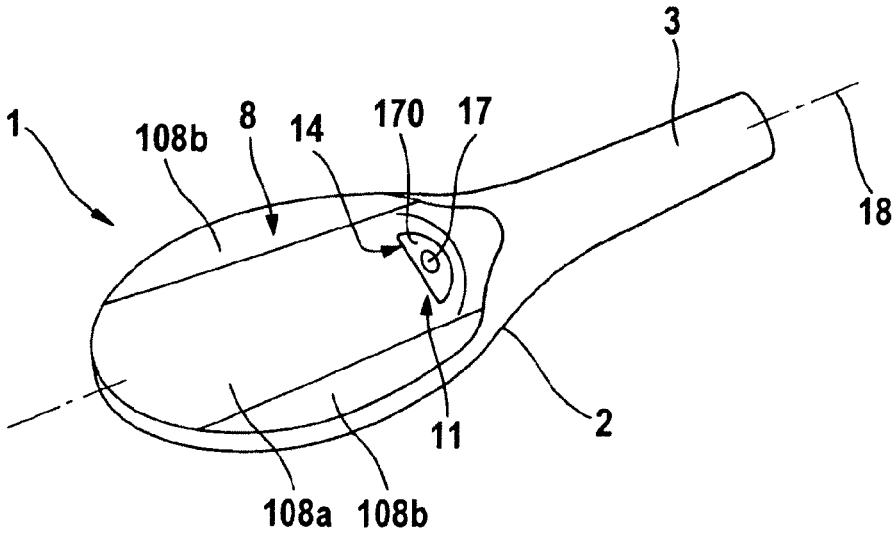

These and other features of the invention are based on the claims, but also on the following description and/or on the accompanying drawings, wherein the features in various combinations and sub-combinations with one another, as well as separately, irrespective of their summary in the claims, can constitute the subject matter of the invention. The invention will be explained in terms of preferred embodiments and related drawings. In the drawings:

FIG. 1 shows a top view of the back of a hair care device in the form of a hairbrush according to an advantageous embodiment of the invention, which shows the ion outlet in the longitudinal plane at the edge of the back of the head function, FIG. 2 shows a longitudinal section of the hairbrush in FIG. 1 along Line A-A referenced there, wherein a grounding surface is positioned on the application head under the tooth field provided there, FIG. 3 shows a top view of the front side of a hairbrush according to a further advantageous embodiment of the invention in which the grounding surface is provided as a surrounding metal strip on the edge of a tooth field forming the application head, FIG. 4 shows a top view of the back of a hairbrush according to a further advantageous embodiment of the invention showing the arrangement of two ion outlets on the edge of the back of the application head, symmetrical to the longitudinal axis, FIG. 5 shows a frontal view of the hairbrush from FIG. 4 showing the principal discharge direction of the ion outlets, angled away from one another and essentially parallel to the back surface of the brush, FIG. 6 shows a top view of the back of a hairbrush according to a further advantageous embodiment of the invention in which two ion outlets are arranged opposite one another in the longitudinal axis of the hairbrush, FIG. 7 shows a longitudinal section of the hair brush in FIG. 6 along Line A-A referenced therein, showing the different inclinations of the ion outlets on the back of the hairbrush, FIG. 8 shows a schematic perspective view of the ion outlets and their outlet housings according to a further advantageous embodiment of the invention in which a bottom surface of the outlet housings is designed as a grounding surface, FIG. 9 shows a frontal plan view of the orifice side of the ion outlet in FIG. 8, FIG. 10 shows a schematic longitudinal section through the ion outlet of the two previous figures, FIG. 11 shows a schematic perspective illustration of an ion outlet according to an alternative advantageous embodiment of the invention, in which only a portion of the bottom side of the outlet housing is designed as a grounding surface, FIG. 12 shows a schematic perspective view illustration of an ion outlet according to a further advantageous embodiment of the invention, in which a portion of a side of the outlet housing is designed as a grounding surface, FIG. 13 shows a schematic perspective view of an ion outlet according to a further advantageous embodiment of the invention, in which the back side of the outlet housing opposite the orifice is designed as a grounding surface, FIG. 14 shows a schematic perspective illustration of a ion outlet according to a further advantageous embodiment of the invention, in which two side surfaces of the outlet housing positioned opposite one another are designed as grounding surfaces, FIG. 15 shows a schematic perspective view of a hair care device in the form of a hairbrush according to a further advantageous embodiment of the invention, with a ion outlet on the back of the hairbrush, wherein the housing component of the device is grounded in the vicinity of the ion outlet, and FIG. 16 shows a schematic perspective view of a hair care device similar to FIG. 15 wherein several separate components are provided in the vicinity of ion outlets on the back of the device, only one of which is grounded and the others are ungrounded.

The hair care device shown in FIGS. 1 and 2 comprises a device grounding body 2 which has a handle 3 and has electronic mechanisms described below in its interior or on its outer shell. Said handle 3 supports an application head 4 which carries a brush field 6 as a hair treatment device 5 on the front of the device 7. It is understood, however, that other hair processing tools, such as, for example, heating elements or hair styling elements or possibly even a blower outlet, may be provided if the hair care device is designed as a hair styling device and/or as a hair dryer. The above hair treatment tools can also possibly be combined with one another.

The said hair treatment device 5 can be permanently integrated into the application head 4. Alternatively, the hair treatment device 5 can advantageously be mounted so as to be interchangeable on the application head 4 so that one application head 4 can be equipped and usable with various hair treatment devices 5.

Advantageously, the hair care device 1 can have a modular design with several interchangeable components, wherein, in particular, the entire application head 4 and/or the hair treatment device 5 may be formed separately from the main body 2 of the device in the manner described above. In this connection, between the various components, positive fitting fasteners can advantageously be provided, for example in the form of snap-in pins and sockets enabling the components to be removed and reinstalled without tools.

As shown in FIGS. 1 and 2, an ion discharging device 9 is additionally provided on the main body of the device 2 on the back side of the device 8 facing away from the hair treatment devise 5, comprising an ion emitter, which can have a high voltage element 12 for discharge of ions arranged in the interior of the main body of the device 2, and/or in the ion outlet 11. The said high voltage element 12 can be arranged in a box or a shell-like outlet housing 13, the walls of which have an outlet opening 17 on the orifice side 14, through which the generated ions can be discharged.

In the illustrated embodiment, the ion outlet 11 is designed as a nozzle or a diffuser and produces a directed ion discharge; cf. FIG. 2. Advantageously, the ion outlet 11 is arranged on the back side 8 of the device opposite the bristle field 6 or faces away from it forming the back of the hairbrush, so to speak. Advantageously, the ion outlet 11 is arranged in the longitudinal plane 18, which forms the plane of projection of FIG. 2, wherein advantageously the ion outlet 11 with its main outlet direction 19 is slightly inclined at an acute angle to the back surface of the device and directed away from this device; cf. FIG. 2, wherein the angle of inclination is advantageously between 0° and 45°, and in the illustrated embodiment, may be advantageously between 20° and 30°. In particular, as shown in FIGS. 1 and 2, the ion outlet 11 is arranged on the edge of the back surface of the application head opposite the bristle field 6, so that the ions discharged from the ion outlet 11 form a cloud of ions over the back of the application head 4. In particular, the ion outlet 11, as shown in FIG. 1, for instance, can be arranged—roughly speaking—in the transition area between the handle 3 and the application head 4.

Inside the main body 2 of the device, a power supply unit, not specifically illustrated, is housed, which preferably can be designed in the form of a battery or rechargeable battery device. Advantageously, the hair care device 1 is designed to be energy self-sufficient, i.e., it does not have a permanent power adaptor that would deliver electricity from the electric socket. Of course, a power cord can be plugged in to charge the batteries inside the main body 2 of the device. The ion discharging device 9 is supplied through the said power supply unit in order to generate ions.

As shown in FIG. 2, the hair care device 1 is advantageously provided with a grounding device 20 to prevent unwanted charging of equipment, to avoid interference with ion discharge and to improve the operational safety of the devices. In the illustrated embodiment according to FIG. 2, the grounding device 20 in the application head 4 can have a grounding surface 21 ("third grounding surface") that prevents high charge fields from developing in the vicinity of the application head 4, especially in the vicinity of the hair treatment device 5. In the embodiment according to FIG. 2, the grounding surface 21 is attached directly to the hair treatment device 5, wherein it is designed as a carrier and is arranged under the hair treatment device 5, and attached to it; cf. FIG. 2. The grounding surface 21 is advantageously made of a metal surface and/or a metal coating applied to the body of the application head, otherwise made of plastic. The grounding surface 21 can be connected to the ground potential of the circuit, for example through custom components arranged inside the device.

Alternatively or additionally, the grounding surface 21 on the application head side can also have a body with a metal surface on the edge of the bristle field 6, preferably in the form of a metal strip surrounding the bristle field 6 in a ring shape, or, as shown in FIG. 3, surrounding it on three sides in a U-shape. The bristle field 6 and the rest of the body of the application head 4 can be designed to be non-conductive, in particular, made of plastic. In the case of a grounding surface 21 at the edge of the bristle field 6 according to FIG. 3, the grounding surface 21 surrounds a large enough portion of the bristle field 6 to sufficiently limit the charges arising there. Advantageously, the metal strip will extend over at least 50% of the area of the hair treatment device 5.

As FIGS. 4 and 5 show, the hair care device 1 on its back side 8 may also have several ion outlets 11, wherein, in the illustrated embodiment according to FIGS. 4 and 5, two ion outlets are provided, which, when seen from the longitudinal axis of the device are at the same height and are positioned symmetrically to each other with respect to the longitudinal plane 18. Advantageously, the ion outlets 11 are arranged on the edge of the back of the application head, wherein they are inclined to one another at an angle of magnitude of 60° to 120°, preferably approximately 90°, to produce a uniformly distributed ion cloud. In the illustrated embodiment, the ion outlets 11 with the main outlet direction 18 are parallel to the surface of the back side 8, so that the ions are discharged essentially parallel to the back of the application head. In the embodiment shown, the ions can discharge from the ion outlets 11 in divergent directions to distribute the ion cloud evenly over the application head 4 or over its back side.

Alternatively to the embodiment according to FIGS. 4 and 5, several ion outlets 11 can be arranged in the longitudinal plane 18; cf. FIGS. 6 and 7. Advantageously, the two ion outlets 11 are positioned opposite one another, wherein they are positioned along the edges on opposite sides of the back of the application head, cf. FIGS. 6 and 7, in order to allow the ion cloud to disperse over the back side of application head.

Advantageously thereby, the two ion outlets 11 may be variously inclined to the surface of the back of the device. While one ion outlet with its main outlet direction 18 is essentially parallel to the surface of the back of the device 8, the other ion outlet 11 is inclined slightly toward the said surface of the back of the device 8, preferably at an angle of 0° to 40°, in particular of 10° to 30°. As FIGS. 6 and 7 show, it can be especially advantageous if the ion outlet 11 arranged in the transitional zone between the handle 3 and the application head 4 is slightly inclined, whereas the ion outlet 11 arranged at the end of the back of the application head remote from the handle 3 can be arranged parallel to the back side of the device 8.

As shown by FIGS. 8 through 10, the grounding system 20 mentioned above also advantageously includes a grounding surface 22 attached to an ion outlet 11 ("first grounding surface"). In particular, this grounding surface 22 is provided on an outer surface of the outlet housing 13 enclosing the ion emitter or its high-voltage element 12. As FIG. 8 shows best, the roughly box-shaped outlet housing 13 encloses orifice side 14 forming a front side, in which an outlet opening 17 is provided for discharging the emitted ions. The high voltage element 12 is arranged in the center of the outlet housing 13 and terminates shortly before the said outlet opening 17 in the interior of the outlet housing 13; cf. FIG. 10. Typically, the high voltage element 12 comprises a wire or consists of one, while the outlet housing is made of plastic for example (the schematic FIG. 10 does not make material differences apparent).

In the embodiment according to FIGS. 8 to 10—based on the high-voltage element 12 peripheral—a side surface 16 is provided with the grounding surface 22. According to FIGS. 8 through 10, this can be a bottom side of the outlet housing 13 facing the grounding body 2. Alternatively or additionally, this can also be a side wall surface 16 of the outlet housing 13, as FIG. 12 shows.

According to FIGS. 8 through 10, the entire bottom side of the outlet housing 13 is designed as a grounding surface 22, in particular in the form of a metal surface, wherein the remainder of the housing is non-conductive and in particular can be made of plastic. As FIG. 11 shows, the corresponding surfaces—in the case of FIG. 11 the bottom side surface—of the outlet housing 13 also can be provided with the grounding surfaces 22, only in sections, namely, the grounding surfaces 22 need not necessarily cover the entire side surface; cf. FIG. 11.

Also in the embodiment according to FIG. 12, only about half of the side surface 16 is designed as a grounding surface 22.

As FIG. 13 shows, the back of the outlet housing 13 opposite the orifice side 14 can also be designed as a grounding surface 22.

Another embodiment is shown in FIG. 14. In this case, opposing side surfaces 16 of the outlet housing 13 are each provided with a grounding surface 22, wherein, in the illustrated embodiment, these are designed only in the form of a strip partially covering the side surfaces 16.

FIG. 15 shows a hair care device 1 according to another embodiment of the invention. Unless otherwise stated, this hair care device may correspond to the preceding embodiments, wherein corresponding reference numerals are used for corresponding components in FIG. 15. In essence, the hair care device according to FIG. 15 differs from the preceding ones in that the entire back of the application head is grounded. The housing component 108, forming the back of the application head 4 and enclosing the ion outlet 11 itself consists of a non-conductive material, in particular plastic, so that the housing component 108 can be electrostatically charged as such. The said housing component 108 is grounded, however, by means of contact with the ground potential of the high voltage circuit, whereby the electrostatic charge, while not impossible, is sufficiently limited so that the electrical counter fields generated by the charge are so small that the distribution of the ions from the ion outlet is not compromised. In this way, electrical grounding can take place on the grounding surface 122 ("second ground plane"). In this way, the grounding surface 122 can also be fashioned as an electrically contacted screw in a screw boss in the housing component 108. Alternatively or additionally, pressure from a metal electrode can be applied to the housing component 108, preferably on the inside. In both cases, therefore, a grounding surface attached to the ground potential positioned on the housing component 108 prevents or suppresses electrostatic charging.

As FIG. 15 shows, the grounded housing component 108 extends to the vicinity of the ion outlet 11, essentially over the entire surface of the rear section of the device body or its section over which the ion cloud emerging from ion outlet 11 spreads out. The grounded housing component 108 extends from the back of the ion outlet 11 facing away from the orifice side of the ion outlet 11, initially over a large surface up to the ion outlet 11, i.e. in the direction of the discharged ions downstream as seen from said ion outlet 11; cf. FIG. 15. The ion outlet 11 forms an island, so to speak, in the surface of the grounded housing component 108, wherein the larger portion of the housing component 108, more than two thirds of the housing component 108 in the embodiment illustrated, is located on the exit side of the ion outlet 11; cf. FIG. 15.

In this way, the said ion outlet 11 is integrated into the said housing component 108, in particular, the latter arches up dome-shaped to make room for the outlet orifice 17 of ion outlet 11, which, in the illustrated embodiment, is preferably formed of a plastic sleeve 170, which encompasses the ion emitter on the outlet side; cf. FIG. 15.

Instead of grounding the housing component in the exit area of the ion emitter across the entire surface shown in FIG. 15, several separate housing components 108*a* and 108*b* can be provided in the vicinity of the ion outlet, as shown in FIG. 16, at least one of which is grounded, while at least one other one is not grounded. The non-grounded parts may charge electrostatically, whereby the ions are deflected. In contrast to this, the ions spread unaffected through the grounded parts, so that overall the ion cloud is controlled. In this respect, the pattern of grounded and ungrounded housing parts in the vicinity of the ion outlet 11 forms an ion control mechanism.

As FIG. 16 shows, this ion control mechanism or the pattern of grounded and ungrounded housing components 108*a* and 108*b* can advantageously be formed or designed symmetrically to the longitudinal axis 18 of the hair care device. Specifically, FIG. 16 illustrates a central housing component 108*a* extending from the ion outlet 11 in a trapezoidal shape, grounded in the aforementioned manner This central strip housing component 108*a* is flanked on the left and on the right by two side housing components 108*b*, which remain ungrounded, and thus can be electrostatically charged. In this embodiment example, the ion control mechanism forms an exit corridor or channel, so to speak, which allows for a targeted ion discharge and suppresses excessive lateral spreading. Depending on the use, however, other patterns of grounded or ungrounded housing components can be provided, to achieve suitable control of distributing the ion cloud.

What is claimed is:

1. A hair care device with a handle, an application head that can be attached to the handle, which has a hair treatment device comprising a bristle field and/or a tooth field and an ion discharging device for applying ions to the hair in a housing having at least one ion outlet arranged on one of the sides of the device facing away from the hair treatment device, characterized in that the application head and/or a housing component in the vicinity of the ion outlet has at least one first grounding surface for removing and/or limiting electronic charging and the back side of the device is provided with at least one second grounding surface.

2. The hair care device according to claim 1, wherein the first grounding surface and/or the second grounding surface comprises a metal surface, which is applied to a non-conductive component of the application head and/or to the housing component in the vicinity of the on outlet.

3. The hair care device according to claim 1, wherein the first grounding surface is on the outside of a component part.

4. The hair care device according to claim 1, wherein the second grounding surface is on the inside of a component part.

5. The hair care device according to claim 1, wherein a third grounding surface is arranged on the application head.

6. The hair care device according to claim 5, wherein the third grounding surface on the application head, surrounds the hair treatment device and is directly adjacent to the hair treatment device.

7. The hair care device according to claim 1, wherein a first grounding surface on the ion outlet forms a housing surface that encloses a high-voltage element for the emission of ions.

8. The hair care device according to claim 7, wherein the housing part enclosing the ion outlet has an orifice side, comprising an outlet opening is for the discharge of ions, and has at least one additional, closed side of the housing, wherein the first grounding surface is on the closed side of the housing.

9. The hair care device according to claim 8, wherein the orifice side of ion outlet is free of counter electrodes.

10. The hair care device according to claim 1, wherein the second grounding surface is adjacent to the ion outlet and downstream from it, considering the direction of ion discharge.

11. The hair care device according to claim 1, wherein all ion outlets are arranged on the back side of the device facing away from the hair treatment device.

12. The hair care device according to claim 11, wherein the ion outlets are arranged around the edges of the back side of the application head to provide an ion cloud over the back side of the application head.

13. The hair care device according to claim 12 comprising a battery to power the ion discharging device .

14. The hair care device, according to claim 13, wherein the application head and/or the hair treatment device is removably attached to the main body of the device forming the handle.

* * * * *